US009683192B2

(12) United States Patent
Iovine et al.

(10) Patent No.: US 9,683,192 B2
(45) Date of Patent: Jun. 20, 2017

(54) LUBRICANT COMPOSITION BASED ON POLYGLYCEROL ETHER

(71) Applicant: TOTAL MARKETING SERVICES, Puteaux (FR)

(72) Inventors: Raphaele Iovine, Mornant (FR); Carine Pizard, Montagny (FR); Pierre Daverat, Vourles (FR); Séverine Thevenet, Vaux en Beaujolais (FR)

(73) Assignee: TOTAL MARKETING SERVICES, Puteaux (FR)

( * ) Notice: Subject to any disclaimer, the term of this patent is extended or adjusted under 35 U.S.C. 154(b) by 16 days.

(21) Appl. No.: 14/652,974

(22) PCT Filed: Dec. 20, 2013

(86) PCT No.: PCT/EP2013/077625
§ 371 (c)(1),
(2) Date: Jun. 17, 2015

(87) PCT Pub. No.: WO2014/096328
PCT Pub. Date: Jun. 26, 2014

(65) Prior Publication Data

US 2016/0264901 A1 Sep. 15, 2016

(30) Foreign Application Priority Data

Dec. 21, 2012 (FR) ..... 12 62703

(51) Int. Cl.

| | |
|---|---|
| ***C10M 145/24*** | (2006.01) |
| ***C10M 129/16*** | (2006.01) |
| ***C10M 133/58*** | (2006.01) |
| *C10N 30/08* | (2006.01) |
| *C10N 40/25* | (2006.01) |

(52) U.S. Cl.
CPC ..... *C10M 129/16* (2013.01); *C10M 133/58* (2013.01); *C10M 145/24* (2013.01); *C10M 2203/1006* (2013.01); *C10M 2203/1025* (2013.01); *C10M 2205/04* (2013.01); *C10M 2205/06* (2013.01); *C10M 2207/04* (2013.01); *C10M 2207/046* (2013.01); *C10M 2207/127* (2013.01); *C10M 2207/262* (2013.01); *C10M 2207/282* (2013.01); *C10M 2209/084* (2013.01); *C10M 2209/103* (2013.01); *C10M 2209/108* (2013.01); *C10M 2215/064* (2013.01); *C10M 2215/28* (2013.01); *C10M 2215/30* (2013.01); *C10M 2219/068* (2013.01); *C10M 2223/045* (2013.01); *C10N 2030/08* (2013.01); *C10N 2040/25* (2013.01); *C10N 2230/06* (2013.01); *C10N 2230/08* (2013.01); *C10N 2230/54* (2013.01); *C10N 2240/10* (2013.01)

(58) Field of Classification Search
CPC ..... C10M 129/16; C10M 133/58; C10M 2203/1006; C10M 2207/04; C10M 2215/30; C10M 145/24; C10M 2207/282; C10M 2209/103; C10M 2209/108; C10M 2215/064; C10M 2207/262; C10M 2219/068; C10M 2223/045; C10M 2209/084; C10M 2207/127; C10M 2207/046; C10M 2205/06; C10M 2205/04; C10M 2203/1025; C10M 2215/28; C10N 2030/08; C10N 2040/25; C10N 2230/08; C10N 2230/54; C10N 2240/10; C10N 2230/06
See application file for complete search history.

(56) References Cited

U.S. PATENT DOCUMENTS

| | | | | |
|---|---|---|---|---|
| 7,783,407 | B2 | 8/2010 | Dequenne | |
| 7,803,745 | B2 | 9/2010 | Kasai | |
| 8,097,570 | B2 | 1/2012 | Boitout et al. | |
| 8,273,189 | B2 | 9/2012 | Derule et al. | |
| 8,334,245 | B2 | 12/2012 | Lancon et al. | |
| 8,980,805 | B2 | 3/2015 | Doyen et al. | |
| 2001/0012821 | A1 | 8/2001 | Koishikawa et al. | |
| 2005/0119134 | A1 | 6/2005 | Tequi et al. | |
| 2008/0096775 | A1* | 4/2008 | Kasai | C10M 129/16 508/129 |
| 2008/0280793 | A1 | 11/2008 | Tequi et al. | |
| 2009/0242079 | A1 | 10/2009 | Derule et al. | |
| 2010/0167969 | A1 | 7/2010 | Doyen et al. | |
| 2010/0275508 | A1 | 11/2010 | Dolmazon et al. | |
| 2011/0059877 | A1 | 3/2011 | Obiols et al. | |
| 2011/0077177 | A1 | 3/2011 | Doyen | |
| 2011/0092403 | A1 | 4/2011 | Lancon et al. | |
| 2012/0053095 | A1 | 3/2012 | Tequi et al. | |
| 2012/0129742 | A1 | 5/2012 | Matray et al. | |
| 2012/0172264 | A1 | 7/2012 | Tequi et al. | |
| 2013/0178402 | A1 | 7/2013 | Chauveau et al. | |
| 2013/0244917 | A1 | 9/2013 | Obrecht et al. | |
| 2013/0267447 | A1 | 10/2013 | Bardin | |

(Continued)

FOREIGN PATENT DOCUMENTS

| | | | |
|---|---|---|---|
| FR | 2970177 | A1 | 7/2012 |
| JP | 2010006917 | A | 1/2010 |

*Primary Examiner* — Taiwo Oladapo
(74) *Attorney, Agent, or Firm* — Harness, Dickey & Pierce, P.L.C.

(57) ABSTRACT

A lubricant composition includes at least one branched polyglycerol ether, and more particularly at least one branched polyglycerol ether and at least one dispersant. A method for reducing fuel consumption of a vehicle utilizing a lubricant composition is also provided. Furthermore, a use of a branched polyglycerol ether as a friction modifier in a lubricant composition is disclosed.

12 Claims, No Drawings

(56) References Cited

U.S. PATENT DOCUMENTS

| | | | |
|---|---|---|---|
| 2014/0041610 | A1 | 2/2014 | Lancon et al. |
| 2014/0235516 | A1 | 8/2014 | Lancon |
| 2015/0119303 | A1 | 4/2015 | Guerin et al. |
| 2015/0126419 | A1 | 5/2015 | Lerasle et al. |

* cited by examiner

LUBRICANT COMPOSITION BASED ON POLYGLYCEROL ETHER

CROSS-REFERENCE TO RELATED APPLICATIONS

This application is a National Phase Entry of International Application Serial No. PCT/EP2013/077625, filed on Dec. 20, 2013, which claims priority to French Patent Application Serial No. 1262703, filed on Dec. 21, 2012, both of which are incorporated by reference herein.

BACKGROUND AND SUMMARY

The present invention relates to the field of lubricants. More particularly, the present invention relates to a lubricant composition comprising at least one branched polyglycerol ether, and more particularly at least one branched polyglycerol ether and at least one dispersant. The lubricant composition according to the invention has good fuel economy properties. The lubricant composition according to the invention moreover has good thermal resistance properties.

The present invention also relates to a method utilizing this composition. The present invention also relates to a method for reducing the fuel consumption of a vehicle utilizing this lubricant composition. The present invention also relates to the use of a branched polyglycerol ether as a friction modifier in a lubricant composition.

The worldwide spread of the automobile since the end of the last century poses problems regarding global warming, pollution, the security and use of natural resources, in particular the depletion of oil reserves. Following the establishment of the Kyoto protocol, new standards protecting the environment require the automobile industry to construct vehicles having reduced pollutant emissions and fuel consumption. As a result, the engines of these vehicles are subject to increasingly stringent technical constraints: in particular they run more quickly, at increasingly high temperatures, and are required to consume less and less fuel.

The nature of engine lubricants for automobiles has an influence on the emission of pollutants and on fuel consumption. Engine lubricants for automobile engines, called energy-saving or "fuel-eco", have been developed in order to meet these new requirements.

The improvement in the energy performance of lubricant compositions can be obtained in particular by mixing specific additives such as friction modifiers, polymers that improve the viscosity index, into base oils. Among the friction modifiers, the organometallic compounds comprising molybdenum are commonly used. In order to obtain good anti-friction properties, a sufficient quantity of molybdenum must be present within the lubricant composition. Among these organometallic compounds, molybdenum dithiocarbamates are most used as a source of molybdenum.

However, these compounds have the drawback of causing the formation of sediments when the lubricant composition has too high a content of elemental molybdenum. The poor solubility of these compounds modifies, or even degrades the properties of the lubricant composition, in particular its viscosity. Now, a composition which is too viscous or not viscous enough militates against the movement of the mobile parts, easy starting of an engine, the protection of an engine when it has reached its operating temperature, and therefore ultimately causes in particular an increase in fuel consumption.

Furthermore, these molybdenum dithiocarbamates contribute to increasing the ash content, reducing their potential for use in a lubricant composition, in particular in Europe. Moreover, the presence of friction modifiers in a lubricant composition can degrade the thermal resistance of the composition, and thus degrade the cleanliness of the engine.

Different technical solutions for replacing the compounds based on molybdenum have been described. Document EP 1 780 257 describes a lubricant composition comprising a polyglycerol ether, said composition having improved fuel economy properties. This document also describes the combination of this ether with a polymer of the polyisobutylene-succinimide type.

However, the polyglycerol ether described in this document has a linear structure. Furthermore, the lubricant composition described in this document finds its application on specific surfaces characterized by a low coefficient of friction, such as surfaces of the DLC (Diamond-Like Carbon) type. Moreover, no quantification of the fuel economy properties and no indication in respect of the thermal resistance of the lubricant composition are given in this document.

As fuel economy requirements are increasing, there is therefore still a need to seek novel friction modifiers which, once formulated in a lubricant composition, do not destabilize it, and allow improved fuel economy properties to be obtained. There is also the need to seek novel friction modifiers which, once formulated in a lubricant composition, do not destabilize it, and allow improved fuel economy properties to be obtained.

An objective of the present invention is to supply a friction modifier as well as a lubricant composition comprising said friction modifier that overcomes all or part of the aforementioned drawbacks. Another objective of the present invention is to supply a lubricant composition that is thermally stable and comprises very little or no compounds based on molybdenum. Another objective of the present invention is to supply a lubricant composition comprising very little or no compounds based on molybdenum and having equivalent, or even improved, friction reduction properties while being capable of application on different surfaces, in particular on surfaces of a different chemical nature. Another objective of the invention is to supply a lubricant composition the formulation of which is easy to implement. Another objective of the present invention is to supply a lubrication method allowing energy savings.

The purpose of the invention is thus a lubricant composition comprising:

at least one base oil, and at least one polyglycerol ether of formula (I)

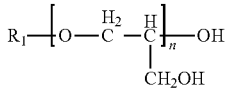

(I)

in which:

$R_1$ represents a linear or branched alkyl group, containing from 1 to 30 carbon atoms;

n represents an integer ranging from 2 to 10.

In an embodiment of the invention, the lubricant composition can comprise:

at least one base oil, at least one polyglycerol ether of formula (I)

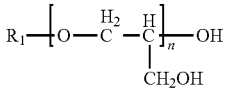

(I)

in which:

$R_1$ represents a linear or branched alkyl group, containing from 1 to 30 carbon atoms;

n represents an integer ranging from 2 to 10, and at least one dispersant.

In another embodiment of the invention, the lubricant composition can comprise:

at least one base oil, at least one polyglycerol ether of formula (I)

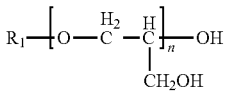

(I)

in which:

$R_1$ represents a linear or branched alkyl group, containing from 1 to 30 carbon atoms;

n represents an integer ranging from 2 to 10, and at least one dispersant chosen from the compounds comprising at least one succinimide group, succinic acid esters or succinic acid amide esters.

In another embodiment of the invention, the lubricant composition can comprise:

at least one base oil, at least one polyglycerol ether of formula (I)

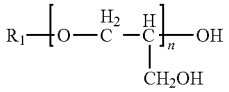

(I)

in which:

$R_1$ represents a linear or branched alkyl group, containing from 1 to 30 carbon atoms;

n represents an integer ranging from 2 to 10, and at least one dispersant chosen from the compounds comprising at least one substituted succinimide group or the compounds comprising at least two substituted succinimide groups, the succinimide groups being linked at their vertex bearing a nitrogen atom by a polyamine group.

Surprisingly, the applicant found that the presence of a polyglycerol ether of formula (I) in a lubricant composition makes it possible to improve the anti-friction properties of the composition, and thus to improve the fuel economy properties. Thus, the present invention makes it possible to formulate lubricant compositions comprising no, or very little, compounds based on molybdenum, and nevertheless having equivalent, or even improved, anti-friction and fuel economy properties.

Advantageously, the lubricant compositions according to the invention have an improved thermal stability. Advantageously, the lubricant compositions according to the invention have an improved stability on storage, as well as a viscosity that varies very little or not at all. Advantageously, the presence of at least one polyglycerol ether of formula (I) in a lubricant composition makes it possible to achieve fuel economies when a motor is idling or running at high speed.

In an embodiment, $R_1$ represents a linear or branched alkyl group, containing from 8 to 25 carbon atoms, preferably from 10 to 20 carbon atoms. In an embodiment, n represents 2, 3, 4 or 5, preferably 2, 3 or 4.

In an embodiment, the polyglycerol ether is chosen from the compounds of formula (I) in which:

R1 represents a linear or branched alkyl group, containing 12 carbon atoms and n represents 2; or R1 represents a linear or branched alkyl group, containing 18 carbon atoms and n represents 2; or R1 represents a linear or branched alkyl group, containing 16 carbon atoms and n represents 3; or R1 represents a linear or branched alkyl group, containing 12 carbon atoms and n represents 4; or R1 represents a linear or branched alkyl group, containing 18 carbon atoms and n represents 4.

In an embodiment, the lubricant composition consists essentially of at least one base oil and at least one polyglycerol ether of formula (I)

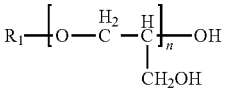

(I)

in which:

$R_1$ represents a linear or branched alkyl group, containing from 1 to 30 carbon atoms;

n represents an integer ranging from 2 to 10.

In an embodiment, the lubricant composition consists essentially of at least one base oil, at least one dispersant and at least one polyglycerol ether of formula (I)

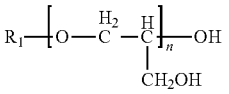

(I)

in which:

$R_1$ represents a linear or branched alkyl group, containing from 1 to 30 carbon atoms;

n represents an integer ranging from 2 to 10.

In an embodiment, the dispersant is chosen from the compounds comprising at least one succinimide group, succinic acid esters or succinic acid amide esters. In an embodiment, the dispersant is chosen from the compounds comprising at least one substituted succinimide group or the compounds comprising at least two substituted succinimide groups, the succinimide groups being linked at their vertex bearing a nitrogen atom by a polyamine group.

In an embodiment, the dispersant is a substituted succinimide of formula (II) or a substituted succinimide of formula (III):

(II)

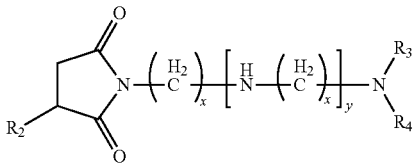

(III)

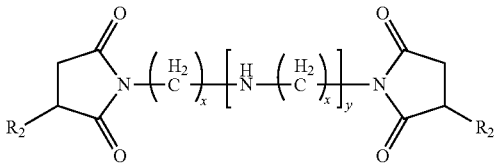

in which:

x represents an integer ranging from 0 to 10, preferably 2, 3, 4, 5 or 6;

y represents an integer ranging from 2 to 6, preferably 2, 3 or 4;

$R_2$ represents an alkyl group comprising from 8 to 400 carbon atoms, preferably from 50 to 200 carbon atoms, an aryl group comprising from 8 to 400 carbon atoms, preferably from 50 to 200 carbon atoms, an arylalkyl group comprising from 8 to 400 carbon atoms, preferably from 50 to 200 carbon atoms or an alkylaryl group comprising from 8 to 400 carbon atoms, preferably from 50 to 200 carbon atoms;

$R_3$ and $R_4$, identical or different, represent independently a hydrogen atom, a linear or branched alkyl group comprising from 1 to 25 carbon atoms, an alkoxy group comprising from 1 to 12 carbon atoms, an alkylene group comprising from 2 to 6 carbon atoms, a hydroxylated alkylene group comprising from 2 to 12 carbon atoms or an alkylene amine group comprising from 2 to 12 carbon atoms.

In an embodiment, the dispersant is a substituted succinimide of formula (II) in which:

$R_2$ represents a polyisobutylene group, $R_3$ and $R_4$ represent a hydrogen atom, x represents 2, y represents 2 or 3.

In an embodiment, the polyglycerol ether content by weight ranges from 0.1 to 3%, preferably from 0.5 to 2%, with respect to the total weight of the lubricant composition. In an embodiment, the dispersant content by weight ranges from 0.1 to 10%, preferably from 0.1 to 5%, advantageously from 0.1 to 3% with respect to the total weight of the lubricant composition. In an embodiment, the mass ratio (mass of polyglycerol ether/mass of dispersant) ranges from 5/1 to 1/5, preferably from 2/1 to 1/2. In an embodiment, the lubricant composition comprises moreover at least one additive chosen from detergents, anti-wear additives, extreme-pressure additives, antioxidants, polymers improving the viscosity index, pour point improvers, anti-foaming agents, thickeners and mixtures thereof.

The invention also relates to an engine oil comprising a lubricant composition as defined above. It relates to the use of a lubricant composition as defined above for reducing the fuel consumption of vehicles. It relates to a method for reducing the energy losses by friction of a mechanical part comprising at least one step of bringing a mechanical part into contact with a lubricant composition as defined above. It relates to a method for reducing the fuel consumption of a vehicle comprising at least one step of bringing a mechanical part into contact with a lubricant composition as defined above.

It relates to the use of a polyglycerol ether of formula (I) as a friction modifier in a lubricant composition (I)

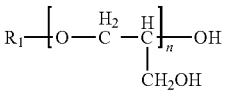

in which:

$R_1$ represents a linear or branched alkyl group, containing from 1 to 30 carbon atoms;

n represents an integer ranging from 2 to 10.

DETAILED DESCRIPTION

Polyglycerol Ether

The polyglycerol ether present in the lubricant composition according to the invention is a compound of formula (I)

(I)

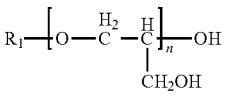

in which:

$R_1$ represents a linear or branched alkyl group, containing from 1 to 30 carbon atoms;

n represents an integer ranging from 2 to 10.

In an embodiment, $R_1$ can represent a linear or branched alkyl group, containing from 8 to 25 carbon atoms, preferably from 10 to 20 carbon atoms. In an embodiment of the invention, n can represent 2, 3, 4 or 5, preferably 2, 3 or 4.

In a preferred embodiment of the invention, the polyglycerol ether can be chosen from the compounds of formula (I) in which:

$R_1$ represents a linear or branched alkyl group containing 12 carbon atoms and n represents 2; or R1 represents a linear or branched alkyl group containing 18 carbon atoms and n represents 2; or $R_1$ represents a linear or branched alkyl group containing 16 carbon atoms and n represents 3; or $R_1$ represents a linear or branched alkyl group containing 12 carbon atoms and n represents 4; or $R_1$ represents a linear or branched alkyl group containing 18 carbon atoms and n represents 4.

Advantageously, the polyglycerol ether is chosen from the compounds of formula (I) in which $R_1$ represents a linear or branched alkyl group containing 12 carbon atoms and n represents 2. As examples of polyglycerol ethers according to the invention, the products Chimexane NV, Chimexane NB, Chimexane NL, Chimexane NA or Chimexane NC marketed by the Chimex company can be mentioned. In an embodiment of the invention, the polyglycerol ether content by weight of formula (I) ranges from 0.1 to 3%, preferably from 0.5 to 2%, with respect to the total weight of the lubricant composition.

Another subject of the invention relates to the use of a polyglycerol ether of formula (I) as a friction modifier in a lubricant composition.

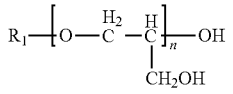

(I)

in which:

$R_1$ represents a linear or branched alkyl group, containing from 1 to 30 carbon atoms;

n represents an integer ranging from 2 to 10.

All the characteristics and preferences presented for the polyglycerol ether of formula (I) present in the lubricant composition also apply to the use of a polyglycerol ether of formula (I) as a friction modifier in a lubricant composition.

Other Compounds

In an embodiment of the invention, the lubricant composition can comprise at least one dispersant. By dispersant is meant more particularly within the meaning of the present invention, any compound which ensures the maintenance in suspension and the removal of the insoluble solid contaminants constituted by the oxidation by-products and unburned products of combustion (soot) which form when a lubricant composition, in particular in the form of an engine oil, is in service.

In an embodiment, the dispersant can be chosen from the compounds comprising at least one succimide group, the succinic acid esters or the succinic acid amide esters, preferably the compounds comprising at least one succinimide group. In a preferred embodiment of the invention, the dispersant can be chosen from the compounds comprising at least one substituted succinimide group or the compounds comprising at least two substituted succinimide groups, the succinimide groups being linked at their vertex bearing a nitrogen atom by a polyamine group. By substituted succinimide group within the meaning of the present invention is meant a succinimide group of which at least one of the vertices is substituted by a hydrocarbon group comprising from 8 to 400 carbon atoms.

Advantageously, the dispersant is a substituted succinimide of formula (II) or a substituted succinimide of formula (III):

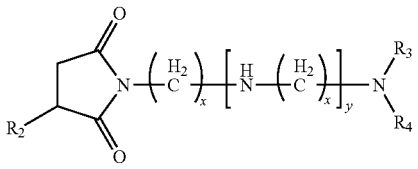

(II)

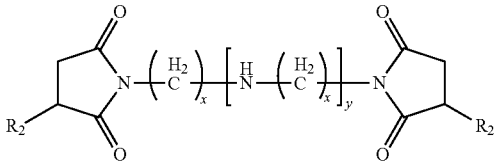

(III)

in which:

x represents an integer ranging from 0 to 10, preferably 2, 3, 4, 5 or 6;

y represents an integer ranging from 2 to 6, preferably 2, 3 or 4;

$R_2$ represents an alkyl group comprising from 8 to 400 carbon atoms, preferably from 50 to 200 carbon atoms, an aryl group comprising from 8 to 400 carbon atoms, preferably from 50 to 200 carbon atoms, an arylalkyl group comprising from 8 to 400 carbon atoms, preferably from 50 to 200 carbon atoms or an alkylaryl group comprising from 8 to 400 carbon atoms, preferably from 50 to 200 carbon atoms;

$R_3$ and $R_4$, identical or different, represent independently a hydrogen atom, a linear or branched alkyl group comprising from 1 to 25 carbon atoms, an alkoxy group comprising from 1 to 12 carbon atoms, an alkylene group comprising from 2 to 6 carbon atoms, a hydroxylated alkylene group comprising from 2 to 12 carbon atoms or an alkylene amine group comprising from 2 to 12 carbon atoms.

Advantageously, the dispersant is a substituted succinimide of formula (II) or a substituted succinimide of formula (III) in which $R_2$ represents a polyisobutylene group. Advantageously, $R_2$ represents a polyisobutylene group having a molecular mass ranging from 800 to 2500 g/mol. Even more advantageously, the dispersant is a substituted succinimide of formula (II) in which:

$R_2$ represents a polyisobutylene group, $R_3$ and $R_4$ represent a hydrogen atom, x represents 2, y represents 2 or 3.

As examples of dispersants according to the invention, the products OLOA 11000 or OLOA 371 can be mentioned, marketed by the Chevron Oronite company, or the product HiTEC 644 marketed by the Afton company. In an embodiment of the invention, the content by weight of dispersant, in particular of dispersant according to formula (II) or of dispersant according to formula (III) ranges from 0.1 to 10%, preferably from 0.1 to 5%, advantageously from 0.1 to 3% with respect to the total weight of the lubricant composition. In an embodiment of the invention, the mass ratio (mass of polyglycerol ether/mass of dispersant) ranges from 5/1 to 1/5, preferably from 2/1 to 1/2.

Base Oils

The lubricant composition according to the present invention comprises at least one base oil which can be chosen from the base oils of Groups I to V as defined in the API (American Petroleum Institute) classification or its European equivalent: the ATIEL (Association Technique de l'Industrie Européenne des Lubrifiants) classification or mixtures thereof. The base oil or the mixture of base oils can be of natural or synthetic origin. The base oil or the mixture of base oils can represent at least 50%, preferably at least 60%, more preferentially at least 70%, yet more preferentially at least 80%, with respect to the total mass of the lubricant composition.

The table below sets out the groups of base oils according to the API classification (Publication API No. 1509 Engine Oil Licensing and Certification System appendix E, 14th Edition, December 1996).

| | Saturated hydrocarbon content | Sulphur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |
| Group IV | (PAO) Polyalphaolefins | | |
| Group V | Esters and other bases not included in bases of Groups I to IV | | |

The oils of Groups I to V can be oils of vegetable, animal, or mineral origin. The base oils referred to as mineral include all types of bases obtained by atmospheric and vacuum distillation of crude oil, followed by refining operations such as solvent extraction, deasphalting, solvent dewaxing, hydrotreating, hydrocracking and hydroisomerization, hydrofinishing. The base oil of the composition according to the invention can also be a synthetic oil, such as certain esters of carboxylic acids and alcohols, or polyalphaolefins. The polyalphaolefins used as base oil, which are distinguished from the heavy polyalphaolefins that can also be present in the compositions according to the invention, can for example be obtained from monomers having from 4 to 32 carbon atoms (for example octene, decene), and have a viscosity at 100° C. ranging from 1.5 to 15 cSt (measured according to the international standard ASTM D445). Mixtures of synthetic and mineral oils can also be used.

Advantageously, the composition according to the invention is formulated to obtain a kinematic viscosity at 100° C. (KV100) ranging from 4 to 25 cSt, preferably from 5 to 22 cSt, more preferentially from 5 to 13 cSt measured according to the international standard ASTM D445. Advantageously, the composition according to the invention is formulated to have a viscosity index greater than or equal to 140, preferentially greater than or equal to 150, more preferentially greater than or equal to 160.

A subject of the invention is also an oil, preferentially an engine oil comprising a lubricant composition according to the invention. All the characteristics and preferences presented for the lubricant composition also apply to the oil according to the invention.

In an embodiment, the oil according to the invention can be of 0W-20 and 5W-30 grade according to the SAEJ300 classification, characterized by a kinematic viscosity at 100° C. (KV100) ranging from 5.6 to 12.5 cSt measured according to the international standard ASTM D445. In another embodiment, the oil according to the invention can be characterized by a viscosity index, calculated according to the international standard ASTM D2230, greater than or equal to 130, preferably greater than or equal to 150, more preferentially greater than or equal to 160. In order to formulate an engine oil, base oils having a sulphur content of less than 0.3%, for example mineral oils of Group III, and sulphur-free synthetic bases, preferentially of Group IV, or mixtures thereof can advantageously be used.

Other Additives

According to an embodiment, the lubricant composition according to the invention can moreover comprise at least one additive. The additive can be chosen from the group formed by anti-wear additives, extreme-pressure additives, antioxidants, overbased or non-overbased detergents, polymers improving the viscosity index, pour point improvers, additional dispersants, anti-foaming agents, thickeners and mixtures thereof. The additive(s) can be introduced alone and/or included in additive packages. The addition of the chosen additive(s) depends on the use of the lubricant composition. These additives and their use depending on the purpose of the lubricant composition are well known to a person skilled in the art. In an embodiment of the invention, the additive(s) are suitable for use as engine oil.

In an embodiment, the lubricant composition can comprise moreover at least one anti-wear additive, at least one extreme-pressure additive or a mixture thereof. The anti-wear and extreme-pressure additives protect the friction surfaces by the formation of a protective film adsorbed on these surfaces. A great variety of anti-wear additives exist, but the category most used in lubricant compositions, in particular for engine oil, is that of the phosphorus- and sulphur-containing additives such as the metallic alkylthiophosphates, in particular the zinc alkylthiophosphates, and more specifically the zinc dialkyldithiophosphates or ZnDTP. The preferred compounds are of formula $Zn((SP(S)(OR_5)(OR_6))_2$, where $R_5$ and $R_6$, identical or different, independently represent an alkyl group, preferentially containing from 1 to 18 carbon atoms. The amine phosphates are also anti-wear additives which can be used in the lubricant compositions according to the invention. However, the phosphorus provided by these additives acts as a poison on the catalytic systems of automobiles as these additives generate ashes. These effects can be minimized by partially substituting the amine phosphates with additives which do not provide phosphorus, such as, for example, the polysulphides, in particular the sulphur-containing olefins. In an embodiment, in particular for an engine application, the anti-wear and extreme-pressure additives can be present in the oil at levels ranging from 0.01 to 6% by mass, preferentially from 0.05 to 4%, preferentially from 0.1% to 2% with respect to the total mass of the engine oil.

In an embodiment of the invention, the lubricant composition can comprise, moreover, at least one additional friction modifier. The additional friction modifier additive can be a compound providing metal elements or an ash-free compound. Among the compounds providing metal elements, there can be mentioned the transition metal complexes such as Mo, Sb, Sn, Fe, Cu, Zn, the ligands of which can be hydrocarbon-containing compounds containing oxygen, nitrogen, sulphur or phosphorus atoms. The ash-free friction modifiers are of organic origin and can be chosen from the monoesters of fatty acids and polyols, alkoxylated amines, alkoxylated fatty amines, fatty epoxides, borated fatty epoxides; fatty amines or glycerol esters of fatty acids. By "fatty" is meant within the meaning of the present invention a hydrocarbon-containing group comprising from 10 to 24 carbon atoms. In an embodiment, the additional friction modifier additive can be present at levels ranging from 0.01 to 2% by mass, preferentially from 0.1 to 1.5% in the lubricant composition, with respect to the total mass of the lubricant composition. In an embodiment for an engine application, the additional friction modifier additive can be present in the engine oil at levels ranging from 0.01 to 5% by mass, preferentially from 0.1 to 2% in engine oils, with respect to the total mass of the engine oil.

In an embodiment, the lubricant composition can comprise, moreover, at least one antioxidant additive. The antioxidant additives slow down the degradation of the lubricant compositions in service, in particular engine oils in service, degradation which can in particular result in the formation of deposits, the presence of sludges, or an increase in the viscosity of the lubricant composition, in particular of the engine oil. The antioxidant additives act in particular as radical inhibitors or hydroperoxide destroyers. Among the antioxidants commonly used, antioxidants of the phenolic or amine type and phosphorus- and sulphur-containing antioxidants can be mentioned. Some of these antioxidants, for example the phosphorus- and sulphur-containing additives, may generate ashes. The phenolic antioxidants may be ash-free, or be in the form of neutral or basic metal salts.

The antioxidant agents can in particular be chosen from the sterically hindered phenols, sterically hindered phenol esters and the sterically hindered phenols comprising a thioether bridge, the diphenylamines, the diphenylamines substituted by at least one C1-C12 alkyl group, the N,N' dialkyl aryl diamines and combinations thereof. By sterically hindered phenol is meant within the meaning of the present invention a compound comprising a phenol group of which at least one vicinal carbon of the carbon bearing the alcohol function is substituted by at least one C1-C10 alkyl group, preferably a C1-C6 alkyl group, preferably, a C4 alkyl group, preferably by the tert-butyl group. The amine compounds are another class of antioxidants which can be used, optionally in combination with the phenolic antioxidants. Typical examples are the aromatic amines of formula $R_7R_8R_9N$, in which $R_7$ represents an aliphatic group or an optionally substituted aromatic group, $R_8$ represents an optionally substituted aromatic group, $R_9$ represents a hydrogen atom, an alkyl group, an aryl group or a group of formula $R_{10}S(O)_zR_{11}$, where $R_{10}$ represents an alkylene group or an alkenylene group, $R_{11}$ represents an alkyl group, an alkenyl group or an aryl group and z represents an integer equal to 0, 1 or 2. Sulphur-containing alkyl phenols or their alkali and alkaline-earth metal salts can also be used as antioxidants. Another class of antioxidants is that of the copper-containing compounds, for example the copper thio- or dithiophosphates, salts of copper and of carboxylic acids, dithiocarbamates, sulphonates, phenates, copper acetylacetonates. Copper I and II, succinic acid or anhydride salts can also be used.

The lubricant composition according to the invention can contain all types of antioxidant additives known to a person skilled in the art. Advantageously, ash-free antioxidants are used. In an embodiment, the lubricant composition according to the invention can comprise from 0.5 to 2% of at least one antioxidant additive by weight with respect to the total mass of the lubricant composition.

In an embodiment, the lubricant composition according to the invention can also comprise a detergent additive. Detergent additives reduce in particular the formation of deposits on the surface of the metal parts by dissolving the by-products of oxidation and combustion. The detergents that can be used in the lubricant composition according to the invention are well known to a person skilled in the art. The detergents commonly used in the formulation of lubricant compositions can be anionic compounds comprising a long lipophilic hydrocarbon-containing chain and a hydrophilic head. The associated cation is typically a metal cation of an alkali or alkaline-earth metal. The detergents are preferentially chosen from the alkali or alkaline-earth metal salts of carboxylic acids, sulphonates, salicylates, naphthenates, as well as the salts of phenates. The alkali or alkaline-earth metals are preferentially calcium, magnesium, sodium or barium. These metal salts can contain the metal in an approximately stoichiometric quantity or in excess (in a quantity greater than the stoichiometric quantity). In the latter case, these detergents are referred to as overbased detergents. The excess metal providing the detergent with its overbased character is present in the form of metal salts which are insoluble in oil, for example carbonate, hydroxide, oxalate, acetate, glutamate, preferentially carbonate. In an embodiment, the lubricant composition according to the invention can comprise from 2 to 4% by weight of detergent, with respect to the total mass of the lubricant composition.

In an embodiment, the lubricant composition can comprise moreover at least one polymer improving the viscosity index. Polymers improving the viscosity index make it possible in particular to guarantee a good low temperature performance and a minimal viscosity at high temperature, in order to formulate multigrade engine oils in particular. Among these compounds the polymer esters, the olefin copolymers (OCP), the homopolymers or copolymers of styrene, butadiene or isoprene, hydrogenated or not hydrogenated, and the polymethacrylates (PMA) can be mentioned.

In an embodiment, the lubricant composition according to the invention can comprise from 1 to 15% by mass of polymers improving the viscosity index, with respect to the total mass of the lubricant composition. In an embodiment for an engine application, the engine oil according to the invention comprises from 0.1 to 10% by mass of polymers improving the viscosity index, with respect to the total mass of the engine oil, preferably from 0.5 to 5%, preferentially from 1 to 2%.

In an embodiment, the lubricant composition according to the invention can comprise moreover at least one pour point depressant additive. Pour point depressant additives in particular improve the low-temperature behaviour of the lubricant compositions, by slowing down the formation of paraffin crystals. As examples of pour point depressant additives, the alkyl polymethacrylates, polyacrylates, polyarylamides, polyalkylphenols, polyalkylnaphthalenes, alkylated polystyrenes can be mentioned.

In an embodiment, the lubricant composition according to the invention can comprise, moreover, at least one additional dispersant additive different from a dispersant according to formula (II) or a dispersant according to formula (III). The additional dispersant additives can be chosen from the groups formed by the succinimides different from a dispersant of formula (II) or (III) or Mannich bases. In an embodiment, the lubricant composition according to the invention can comprise from 0.2 to 10% in total mass of dispersants, including the dispersant of formula (II) or the dispersant of formula (III) and at least one additional dispersant, with respect to the total mass of the lubricant composition.

A subject of the invention is also a lubricant composition comprising:

from 50 to 90% of a base oil, from 0.1 to 3% of a polyglycerol ether of formula (I).

All the characteristics and preferences presented for the base oil and the polyglycerol ether of formula (I) also apply to the aforementioned lubricant composition.

A subject of the invention is also a lubricant composition comprising:

from 50 to 90% of a base oil, from 0.1 to 3% of a polyglycerol ether of formula (I), from 0.1 to 10% of a dispersant.

All the characteristics and preferences presented for the base oil, the polyglycerol ether of formula (I) and the dispersant also apply to the aforementioned lubricant composition.

A subject of the invention is also a lubricant composition consisting essentially of:

from 50 to 90% of a base oil, from 0.1 to 3% of a polyglycerol ether of formula (I), from 0.1 to 10% of a dispersant.

A subject of the invention is also a composition comprising:

at least one polyglycerol ether of formula (I), at least one dispersant comprising at least one succinimide group.

All the characteristics and preferences presented for the polyglycerol ether of formula (I) and for the dispersant comprising at least one succinimide group also apply to the aforementioned lubricant composition.

A subject of the invention is also a composition comprising:

at least one polyglycerol ether of formula (I), at least one dispersant comprising at least one succinimide group, at least one additional additive.

All the characteristics and preferences presented for the polyglycerol ether of formula (I), for the dispersant comprising at least one succinimide group and for the additional additive also apply to the aforementioned composition.

In an embodiment, the composition can comprise:

from 10 to 40%, preferably from 20 to 40% of polyglycerol ether of formula (I), from 10 to 40%, preferably from 20 to 40% of a dispersant comprising at least one succinimide group, from 20 to 50%, preferably from 30 to 50% of at least one additional additive.

In an embodiment, the mass ratio (mass of polyglycerol ether of formula (I):mass of dispersant comprising at least one succinimide group) can range from 1:1 to 1:65. In an embodiment of the invention, at least one base oil can be added to the composition according to the invention in order to obtain a lubricant composition according to the invention.

The Parts

The lubricant composition according to the invention can lubricate at least one mechanical part or one mechanical unit, in particular bearings, gears, universal joints, transmissions, the pistons/rings/liners system, camshafts, clutch, manual or automatic gearboxes, rocker arms, crankcases etc.

A subject of the invention is also a method for reducing the energy losses by friction of a mechanical part, said method comprising at least one step of bringing a mechanical part into contact with a lubricant composition according to the invention. All the characteristics and preferences presented for the lubricant composition also apply to the method for reducing the energy losses by friction of a mechanical part according to the invention. A subject of the invention is also a method for reducing the fuel consumption of a vehicle, the method comprising at least one step of bringing a lubricant composition according to the invention into contact with at least one mechanical part of the engine of the vehicle.

All the characteristics and preferences presented for the lubricant composition also apply to the method for reducing the fuel consumption of a vehicle according to the invention. A subject of the invention is also the use of a lubricant composition according to the invention for reducing the fuel consumption of vehicles. All the characteristics and preferences presented for the lubricant composition also apply to the use for reducing the fuel consumption of vehicles according to the invention.

The vehicles can comprise a two- or four-stroke internal combustion engine. The engines can be gasoline engines or diesel engines intended to be supplied with standard gasoline or diesel. By "standard gasoline" or by "standard diesel" is meant within the meaning of the present invention engines which are supplied with a fuel obtained after refining an oil of mineral origin (such as petroleum for example). The engines can also be gasoline engines or diesel engines modified to be supplied with a fuel based on oils originating from renewable materials such as fuels based on alcohol or biodiesel fuel. The vehicles can be light vehicles such as automobiles and motor cycles. The vehicles can also be lorries, construction machinery, vessels.

A subject of the invention is also the use of a lubricant composition according to the invention for reducing the energy losses by friction of a metal part, preferentially in the bearings, gears or universal joints. All the characteristics and preferences presented for the lubricant composition also apply to the use for reducing the energy losses by friction of a metal part according to the invention. The different subjects of the present invention and their implementations will be better understood on reading the examples which follow. These examples are given by way of indication, without being limitative.

EXAMPLE 1

Evaluation of the Coefficient of Friction of Lubricant Compositions According to the Invention A control lubricant composition was prepared according to Table I

TABLE I

| | Control composition A |
|---|---|
| Group III base oils | 79.8% |
| Hydrogenated polydiene (Shellvis 261 marketed by Shell) | 1.7% |
| Styrene/isoprene block copolymer (Shellvis 151 marketed by the Shell company) | 5% |
| Linear polyalkylmethacrylate (LZ 7748 marketed by the Lubrizol company) | 0.3% |
| Additive package comprising calcium salicylate (10-20% MA), a zinc dithiophosphate (5-10% MA), an amine anti-oxidant and a dispersant comprising at least one substituted succinimide group (PIB succinimide) | 13.2% |

The composition B (comparative) and the compositions C, D and E (according to the invention) were prepared according to Table II below; the percentages indicated are percentages by mass.

TABLE II

| | A (control) | B (comparative) | C (invention) | D (invention) | E (invention) |
|---|---|---|---|---|---|
| Control composition A | 100% | 99.6% | 99% | 99% | 99% |
| Molybdenum dithiocarbamate (Sakura-lube 525 marketed by the Adeka company) | | 0.4% | | | |
| Polyglycerol ether of formula (I) with R = C18 alkyl group and n = 2 (Chimexane NB marketed by the Chimex company) | | | 1% | | |
| Polyglycerol ether of formula (I) with R = C12 alkyl group and n = 2 (Chimexane NV marketed by the Chimex company) | | | | 1% | |

TABLE II-continued

| | A (control) | B (comparative) | C (invention) | D (invention) | E (invention) |
|---|---|---|---|---|---|
| Polyglycerol ether of formula (I) with R = C12 alkyl group and n = 4 (Chimexane NA marketed by the Chimex company) | | | | | 1% |

The coefficient of friction of each composition was evaluated by a Cameron Plint laboratory friction test using a reciprocating tribometer of the Cameron-Plint TE-77 type. The test bench is constituted by a cylinder-on-flat tribometer immersed in the lubricant composition to be tested. The coefficient of friction is monitored throughout the test by measuring the tangential force over the normal force. A cylinder (SKF 100C6) having a length of 10 mm and diameter 7 mm is applied onto the steel flat immersed in the lubricant composition to be tested; the temperature of the lubricant composition is set at each test. A sinusoidal reciprocating movement is applied with a defined frequency. Each test lasts for 100 seconds. Three load levels were studied; 52N, 115N and 255N.

The values of the coefficient of friction taken at different temperatures, loads and frequencies and for each of the compositions A, B, C, D and E, are indicated in Table III.

TABLE III

| | A | B | C | D | E |
|---|---|---|---|---|---|
| Average coefficient of friction (51° C., 52N, 20 Hz) | 0.117 | 0.090 | 0.081 | 0.100 | 0.093 |
| Average coefficient of friction (107° C., 52N, 20 Hz) | 0.138 | 0.074 | 0.077 | 0.079 | 0.079 |
| Average coefficient of friction (110° C., 52N, 10 Hz) | 0.152 | 0.081 | 0.079 | 0.086 | 0.104 |
| Average coefficient of friction (103° C., 115N, 10 Hz) | 0.140 | 0.069 | 0.070 | 0.083 | 0.104 |
| Average coefficient of friction (153° C., 255N, 10 Hz) | 0.141 | 0.106 | 0.085 | 0.068 | 0.102 |
| Average coefficient of friction (151° C., 255N, 20 Hz) | 0.139 | 0.098 | 0.087 | 0.075 | 0.105 |

The results show that the presence of a polyglycerol ether of formula (I) according to the invention combined with a dispersant comprising at least one substituted succinimide group in a lubricant composition makes it possible to significantly reduce the coefficient of friction of the lubricant composition with respect to the control composition. Furthermore, it should be noted that the coefficients of friction obtained with a polyglycerol ether of formula (I) according to the invention are very close, or even below, the coefficients of friction obtained with a friction modifier based on molybdenum.

EXAMPLE 2

Evaluation of the Fuel Economy Properties of Lubricant Compositions According to the Invention The (comparative) composition F was prepared comprising:

99.7% by weight of the control composition A, 0.3% by weight of a friction modifier based on molybdenum (Sakura-lube 525 marketed by the Adeka company).

The fuel economy (Fuel Eco) properties are evaluated between the control composition A, the composition D of Example 1 and the composition F according to the following method:

These tests are carried out on engine K9K724, the characteristics of which are as follows:

Turbocharged 4-cylinder 4-stroke diesel

Cylinder capacity: 1461 cm3

Output: 63 kW at 3750 rpm

Max torque: 200 Nm at 1900 rpm.

A test is constituted by a series of measurements carried out over 10 operation points (see Table IV below). These 10 points represent 75% of the NEDC (New European Driving Cycle)

TABLE IV

| Phase | Speed (rpm) - Torque (Nm) |
|---|---|
| Phase 1 cold | 2000 rpm - 69.8 Nm |
| Phase 1 cold | 1750 rpm - 58.1 Nm |
| Phase 1 cold | 1750 rpm - 34.9 Nm |
| Phase 1 cold | 1500 rpm - 11.6 Nm |
| Phase 2 warm | 2000 rpm - 180 Nm |
| Phase 2 warm | 4000 rpm - 140 Nm |
| Phase 2 warm | 3500 rpm - 120 Nm |
| Phase 2 warm | 2750 rpm - 104.6 Nm |
| Phase 2 warm | 2250 rpm - 81.2 Nm |
| Phase 2 warm | 1750 rpm - 58.1 Nm |

The measurements are carried out over 3 thermal phases:

Phase 1 cold corresponding to a temperature of the coolant: 40° C. (at 45° C. for the lubricant composition to be tested), Phase 2 warm corresponding to a temperature of the coolant: 90° C. (at 100° C. for the lubricant composition to be tested).

Regulation of the fluids is carried out as follows:

The temperature of the fuel is regulated by a fuel conditioning system (Fuel Exact marketed by the AVL company) allowing instantaneous measurements to be taken, The temperature of the composition to be tested is regulated via the coolant by an exchanger as on the vehicle.

The temperature of the fluids is accurately controlled:

the temperature variations for the water and for the lubricant composition to be tested are less than 0.1° C., the temperature variations for the fuel are less than 0.1° C.

A fuel consumption indicator is calculated from the gross consumption in kg/h and from the cumulative time weighting in order to give a percentage improvement for each phase.

The results are shown in Table V. The greater the reduction, the greater the fuel economy.

TABLE V

| | A | D | F |
|---|---|---|---|
| Fuel Eco gain when cold | 0% | −0.4% | −0.5% |
| Fuel Eco gain when warm | 0% | −0.5% | −0.5% |

The results show that the presence of a polyglycerol ether of formula (I) combined with a dispersant comprising at least one substituted succinimide group in a lubricant composition allows significant fuel economy properties to be obtained equivalent to those obtained with a friction modifier based on molybdenum combined with a dispersant comprising at least one substituted succinimide group.

EXAMPLE 3

Evaluation of the Thermal Stability of Lubricant Compositions According to the Invention The compositions G, H, I and K (comparative) and the composition J (according to the invention) were prepared according to Table VI below; the percentages indicated are percentages by mass. The base oils are polyalphaolefins. Compound 1 is a zinc dithiophosphate (LZ 1371 marketed by the Lubrizol company).

The friction modifier 2 is based on molybdenum (Sakura-Lub 525 marketed by the Adeka company). The friction modifier 3 is based on molybdenum (Molyvan 855 marketed by the Vanderbilt company). Compound 4 is a polyglycerol ether of formula (I) with R=C12 alkyl group and n=2 (Chimexane NV marketed by the Chimex company). The dispersant 5 is a dispersant comprising a substituted succinimide group (OLOA 11000 marketed by the Chevron Oronite company). The polymer 6 is a hydrogenated polydiene (Shellvis 261 marketed by the Shell company).

TABLE VI

| | G (comparative) | H (comparative) | I (comparative) | J (invention) | K (comparative) |
|---|---|---|---|---|---|
| Base oils | 83.70% | 81.70% | 80.90% | 80.70% | 81.70% |
| Compound 1 | 1% | 1% | 1% | 1% | 1% |
| Trimethylolpropanetriole | 10% | 10% | 10% | 10% | 10% |
| Friction modifier 2 | | | 0.30% | | |
| Friction modifier 3 | | | 0.50% | | |
| Compound 4 | | | | 1% | 1% |
| Dispersant 5 | | 1% | 1% | 1% | |
| Polymer 6 | 5% | 6% | 6% | 6% | 6% |
| Other additives (Alphaolefin amine: LZ 5150C marketed by the Lubrizol company; anti-foaming agent) | 0.30% | 0.30% | 0.30% | 0.30% | 0.30% |

The comparison of the compositions G, H, I, J and K is carried out at iso-viscosity. In order to obtain a kinematic viscosity at 100° C. measured according to the standard ASTM D445 of approximately 8 cSt for each of these compositions, it is necessary to adjust the mass contents of the base oil and of the polymer 6 depending on the presence or absence of the different constituents. It is thus necessary to use 5% by weight of polymer 6 in the composition G in order to obtain a kinematic viscosity of approximately 8 cSt while 6% by weight of the polymer 6 is necessary in order to obtain the same kinematic viscosity (approximately 8 cSt) for the compositions H, I, J and K. A measurement of thermal stability (MCT or Microcoking Test) was carried out for each composition by the following microcoking method based on the standard GFC Lu-27-T-07. The purpose of the microcoking method is:

evaluating the tendency of a lubricant composition to form deposits when it is subjected to high temperatures (thermal stability), predicting the behaviour of a lubricant composition under engine testing.

A quantity of lubricant composition to be tested of 0.6 $cm^3$ is placed in the trough of an aluminium alloy plate, then heated at one end (hot point) and regulated at the other end (cold point). Measuring the temperature between these two points makes it possible to establish the estimated linear thermal gradient between the two ends of the trough. The standard duration of the test is 90 minutes. At the end of the test, the temperatures of formation of the deposits are determined and their rating according to the method CEC M-02-A-78 is carried out.

The results are shown in Table VII below. The higher the MCT value, the better the thermal stability of the lubricant composition.

TABLE VII

| | G | H | I | J | K |
|---|---|---|---|---|---|
| MCT | 6.38 | 6.54 | 4.1 | 7.71 | 6.38 |

The results show that the presence of a polyglycerol ether of formula (I) combined with a dispersant comprising at least one succinimide group, and more particularly a dispersant comprising a substituted succinimide group in a lubricant composition has the advantage of obtaining an improved thermal stability of the lubricant composition. The results show in particular a synergy of activity of the combination of a polyglycerol ether of formula (I) and a dispersant comprising at least one substituted succinimide group (composition J), the thermal stability obtained by this combination being significantly higher than the thermal stability obtained with a dispersant comprising at least one substituted succinimide group alone and in the absence of a polyglycerol ether of formula (I) (composition H) and the thermal stability obtained with a polyglycerol ether of formula (I) alone and in the absence of a dispersant comprising at least one substituted succinimide group (composition K).

It should be noted that the composition I comprising a friction modifier based on molybdenum has a low thermal stability, even in the presence of a dispersant comprising a substituted succinimide group. It should also be noted that the lubricant compositions according to the invention have the advantage, compared to the compositions comprising at least one friction modifier based on molybdenum, of forming little or no ash.

The invention claimed is:

1. A lubricant composition comprising:

at least one base oil;

at least one polyglycerol ether of formula (I)

(I)

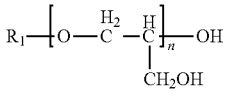

in which:

$R_1$ represents a linear or branched alkyl group, containing from 1 to 30 carbon atoms;

n represents an integer ranging from 2 to 10 and at least one dispersant chosen from the compounds comprising at least one substituted succinimide group or the compounds comprising at least two substituted succinimide groups, the succinimide groups being linked at their vertex bearing a nitrogen atom by a polyamine group.

2. The lubricant composition according to claim 1, in which $R_1$ represents a linear or branched alkyl group, containing from 8 to 25 carbon atoms.

3. The lubricant composition according to claim 1, in which n represents 2, 3, 4 or 5.

4. The lubricant composition according to claim 1, in which the polyglycerol ether is chosen from the compounds of formula (I) in which:

$R_1$ represents a linear or branched alkyl group containing 12 carbon atoms and n represents 2; or $R_1$ represents a linear or branched alkyl group containing 18 carbon atoms and n represents 2; or $R_1$ represents a linear or branched alkyl group containing 16 carbon atoms and n represents 3; or $R_1$ represents a linear or branched alkyl group containing 12 carbon atoms and n represents 4; or $R_1$ represents a linear or branched alkyl group containing 18 carbon atoms and n represents 4.

5. The lubricant composition according to claim 1, in which the dispersant is a substituted succinimide of formula (II) or a substituted succinimide of formula (III):

(II)

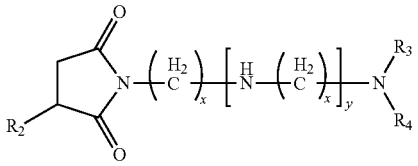

(III)

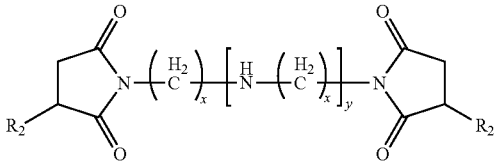

in which:

x represents an integer ranging from 0 to 10;

y represents an integer ranging from 2 to 6;

$R_2$ represents an alkyl group comprising from 8 to 400 carbon atoms, an aryl group comprising from 8 to 400 carbon atoms, an arylalkyl group comprising from 8 to 400 carbon atoms, or an alkylaryl group comprising from 8 to 400 carbon atoms; and $R_3$ and $R_4$, identical or different, represent independently a hydrogen atom, a linear or branched alkyl group comprising from 1 to 25 carbon atoms, an alkoxy group comprising from 1 to 12 carbon atoms, an alkylene group comprising from 2 to 6 carbon atoms, a hydroxylated alkylene group comprising from 2 to 12 carbon atoms or an alkylene amine group comprising from 2 to 12 carbon atoms.

6. The lubricant composition according to claim 5, in which the dispersant is a substituted succinimide of formula (II) in which:

$R_2$ represents a polyisobutylene group, $R_3$ and $R_4$ represent a hydrogen atom, x represents 2, and y represents 2 or 3.

7. The lubricant composition according to claim 1, in which the content by weight of polyglycerol ether ranges from 0.1 to 3%, with respect to the total weight of the lubricant composition.

8. The lubricant composition according to claim 1, in which the content by weight of dispersant ranges from 0.1 to 10%, with respect to the total weight of the lubricant composition.

9. The lubricant composition according to claim 1, in which the mass ratio (mass of polyglycerol ether/mass of dispersant) ranges from 5/1 to 1/5.

10. The lubricant composition according to claim 1, comprising moreover at least one additive chosen from detergents, anti-wear additives, extreme-pressure additives, antioxidants, polymers improving the viscosity index, pour point improvers, anti-foaming agents, thickeners and mixtures thereof.

11. A method for reducing fuel consumption of a vehicle comprising at least one step of bringing a mechanical part of a vehicle engine into contact with a lubricant composition comprising:

at least one base oil;

at least one polyglycerol ether of formula (I)

(I)

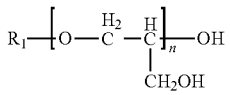

in which:

$R_1$ represents a linear or branched alkyl group, containing from 1 to 30 carbon atoms;

n represents an integer ranging from 2 to 10; and at least one dispersant chosen from the compounds comprising at least one substituted succinimide group or the compounds comprising at least two substituted succinimide groups, the succinimide groups being linked at their vertex bearing a nitrogen atom by a polyamine group.

12. A method for modifying the friction properties of a lubricant composition, comprising adding to the lubricant composition a polyglycerol ether of formula (I)

(I)

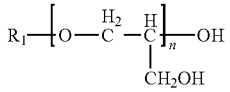

in which:

$R_1$ represents a linear or branched alkyl group, containing from 1 to 30 carbon atoms; and n represents an integer ranging from 2 to 10.

* * * * *